United States Patent [19]

Huddleston

[11] Patent Number: 5,038,987

[45] Date of Patent: Aug. 13, 1991

[54] BOW SUPPORT APPARATUS

[76] Inventor: Jerry Huddleston, 1685 Victor Ave., Ypsilanti, Mich. 48198

[21] Appl. No.: 463,846

[22] Filed: Jan. 12, 1990

Related U.S. Application Data

[63] Continuation of Ser. No. 305,450, Feb. 1, 1989, abandoned.

[51] Int. Cl.[5] ..... A45F 3/14

[52] U.S. Cl. ..... 224/258; 224/268; 224/916

[58] Field of Search ..... 224/916, 257, 258, 202, 224/268, 150, 149, 913, 904, 254, 205, 206; 124/88, 90, 91

[56] References Cited

U.S. PATENT DOCUMENTS

| | | | |
|---|---|---|---|
| 279,706 | 6/1883 | Carroll | 224/268 |
| 2,574,143 | 11/1951 | Colby | 224/182 |
| 3,168,971 | 2/1965 | Goertzen | 224/916 |
| 3,211,351 | 10/1965 | Somple | 224/150 |
| 4,431,122 | 2/1984 | Garmong | 224/268 |
| 4,684,047 | 8/1987 | Burgwin | 224/916 |
| 4,768,689 | 9/1988 | Davis | 224/257 |

FOREIGN PATENT DOCUMENTS

| | | | |
|---|---|---|---|
| 73084 | 2/1948 | Norway | 224/913 |

*Primary Examiner*—Linda J. Sholl
*Attorney, Agent, or Firm*—Krass & Young

[57] ABSTRACT

A center-mount bow-string holder is provided for use by an archer, e.g. with a sling, for carrying a bow or standing with an armed or unarmed bow. The holder includes spaced-apart hooks for supporting a horizontally held bow-string. For support, the bow-string is centered-balanced between the hooks with the bow-string supported on the hooks. The axial spacing of the hooks is such that the same serve as a guide for and are closely adjacent to the arrow nock end when placed on and held by the low-string and further the lateral spacing for each hook is such as to allow the archer to move the armed or unarmed bow silently and freely in and out of the holder, as desired.

5 Claims, 2 Drawing Sheets

BOW SUPPORT APPARATUS

This is a continuation of co-pending application Ser. No. 305,450 filed on Feb. 1, 1989 now abandoned.

TECHNICAL FIELD

This invention concerns archery equipment and more particularly bow support apparatus for holding an armed or unarmed bow at the ready e.g. on a target line or in the field, without requiring the apparatus to be held by the hands, i.e. with the hands free.

BACKGROUND OF THE INVENTION

To avoid the need for manually holding a string bow, whether armed or unarmed, various shoulder slings and neck slings have been provided to support the bow, usually with the string below the handle with the result that although carrying the sling bow is more convenient, the bow is not in a ready or firing position. An improved apparatus with the bow-string supported over the bow is provided by the patent to Davis, U.S. Pat. No. 4,768,689, incorporated herewith by reference. The Davis apparatus uses a sling e.g. an over-the-shoulder sling with a forward hook and a rearward hook widely spaced apart for hooking and supporting the bow-string. To free the bow from the sling, the bow-string is lifted or otherwise separated from the spaced hooks. The lifting tends to be inconvenient, particularly with the rearward (behind-the-shoulder) hook. Also, the resulting unhooked sling can then fall away from the shoulder, or be distracting or in its fall cause unwanted noise or movement in the field.

It is therefore an object of the present invention to provide an improved unitary bow-string holder for supporting a bow at or closely adjacent to the balance point thereof.

It also is an object of the invention to provide a holder of the kind described from which holder when sling supported the bow can be manually disengaged freely and quietly without dislodging the holder and, if desired, moved to a firing position.

It is a further object to provide a holder with a pair of hooks spaced apart such that they define a closely confining space therebetween for the nock end of an arrow on a bow-string supported by the hooks.

These and other objects, features and advantages will be apparent from the following description, to those skilled in the art.

SUMMARY OF THE INVENTION

The bow-string holder of the invention in a preferred embodiment is for use with a sling by an archer and while sling-held for carrying a bow or standing with an armed or unarmed bow. The bow-string holder preferably unitary in structure, has front and rear margins and includes at the front margin a cooperating pair of spaced apart outwardly extending hooks or structural equivalents, preferably J-shaped, preferably matching and preferably parallel, for engagement in hooking and upwardly supporting relation in contact with the horizontally held bow-string of a bow depending from the bow-string. The hooks while so engaged are positioned for balance axially with respect to the bow-string at or closely adjacent to the balance point of the bow which balance point for purposes of the invention may be located by a string mark or string nock. The axial spacing between the hooks preferably coordinates with the arrow nock, i.e. approximates the diameter of an arrow, being such that the hooks lie closely adjacent to the arrow end or nock end when the arrow is placed on and held by the bow-string. In this regard, the hooks advantageously serve as a guide for arming the bow.

The rear margin of the holder is provided with sling means or with means for attaching a sling thereto such as an opening or open slot for receiving a sling strap to be worn by the archer for carrying and standing with the bow.

The lateral spacing of the open hook (e.g. the spacing between the lip and the back of a J-shape hook) relative to the diameter of the bow-string preferably is such as to allow silent and free movement of the bow and its bow-string into and from the sling-held holder. In this regard, the bow-string holder of the invention preferably is used with a hands-free armable bow-string, i.e. a bow-string of sufficient diameter that holds the arrow nock end when the bow is carried by the handle or as described by a sling.

In one preferred embodiment, the mentioned sling attachment means is a sling strap that is slideable through the holder slot to facilitate size adjustment of the sling. In another preferred embodiment which has an advantage of not twisting especially in the field, the sling strap is a closed loop for passing the end of a sling therethrough, preferably a sling having means for adjusting its effective length size.

BRIEF DESCRIPTION OF THE DRAWINGS

Referring to the drawings.

DESCRIPTION OF THE PREFERRED EMBODIMENTS

Figure 1:
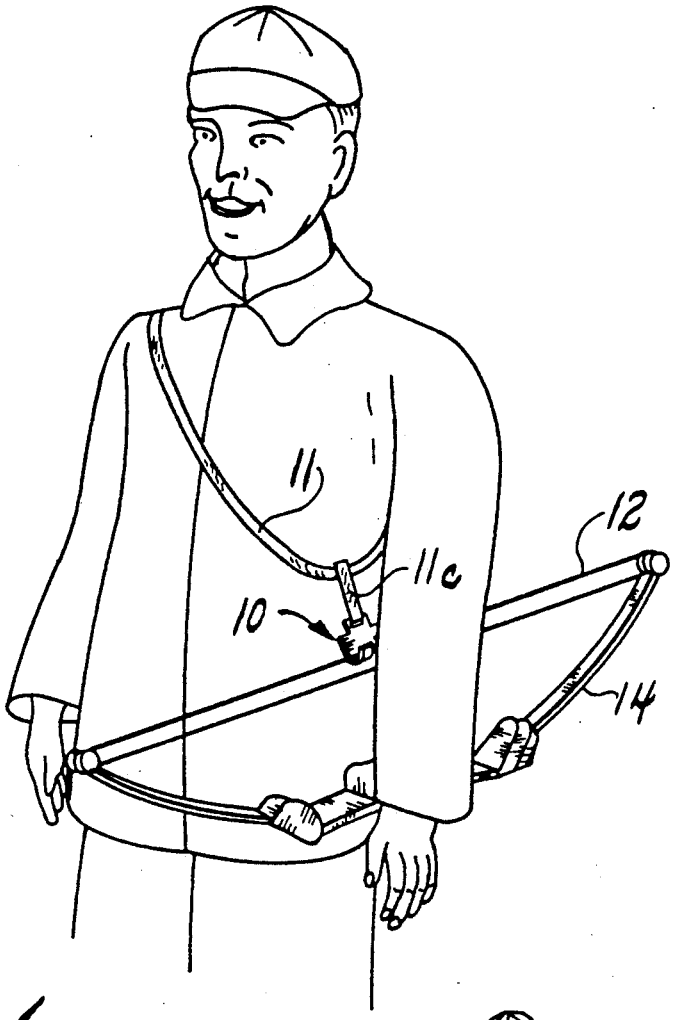
FIG. 1 is a view of an archer with a bow-string holder device of the invention holding a bow at the side with a sling in an over-the-shoulder position.
Figure 2:
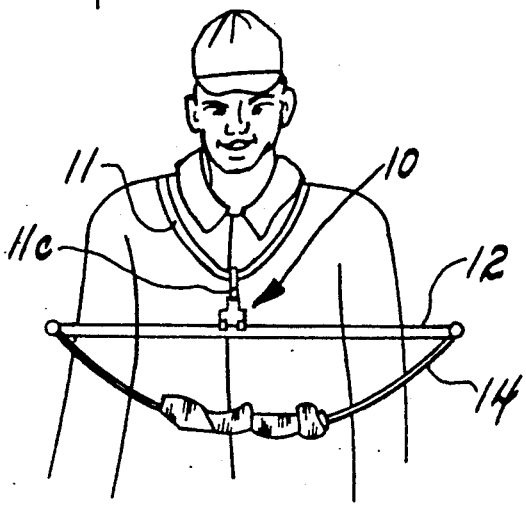
FIG. 2 is a similar view with a holder device of the invention holding a bow in front with a sling in an around-the-neck position.

As shown in FIG. 1, the bow-string holder device 10 in a preferred embodiment is carried on a sling 11 at the user's side and is centered axially with respect to the bow-string 12 holding the same at or closely adjacent to the balance point 12*a* (FIGS. 3A, 3B and 3C) of the bow 14. As shown in FIG. 2, the bow 14 can be carried in front by a round-the-neck sling 11 which in turn is attached to the bow-string holder device 10 that supports the bow-string 12 centrally.

As shown in FIGS. 3A, 4A, 3B and 4B, the bow-string holder 10 has a body 15 with front and rear margins 15*a*, 15*b*. Extending from the front margin are spaced apart hook bodies 16*a*, 16*b* each having a hook lip 17*a*, 17*b*. Each body and lip join together in a J-shape hook, forming an inner support surface 19 for supporting therein a bow-string 12 (shown in dotted outline) laid or placed upon the two hooks, as illustrated. The bow-string 12 at its mid-point or axial (i.e. length-axis) center has a balance point 12*a*, the location of which may be indicated in one preferred embodiment (FIG. 3A) by a string nock 12*b* (shown in dotted outline). When the bow-string is placed into the holder 10 with one hook 16*b*, 17*b* touching against the string nock 12*b*, the central axis of the holder 10 or line of its bilateral symmetry is advantageously lined up with the balance point 12*a* of the bow. In this position, the holder hooks advantageously serve as a guide for correct placement of the arrow nock on the balance point of the bow-string and aid in providing assured clearance for safely installing the bow into the holder and removing it from the holder without distraction, even under adverse conditions such as are encountered in the cold and even in darkness.

Figure 4A:
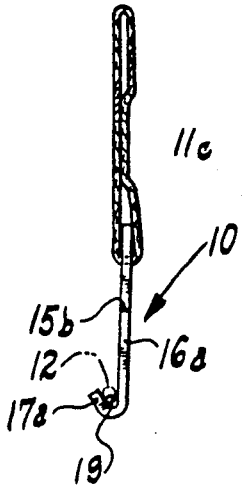
FIGS. 4A, 4B and 4C are side views respectively of the preferred embodiments illustrated in FIGS. 3A, 3B and 3C.
Figure 3A:
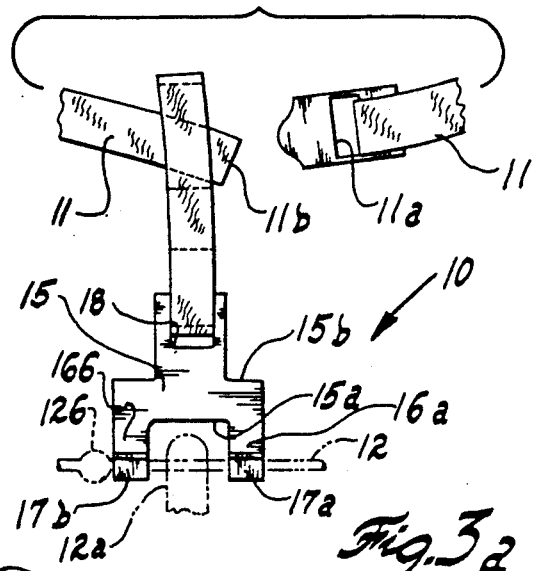
FIGS. 3A, 3B and 3C are front views respectively of preferred embodiments of a bow-string holder device of the invention.
Figure 4B:
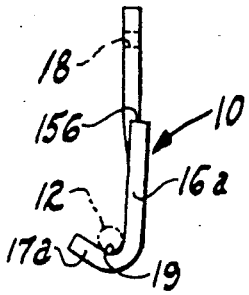
Figure 3B:
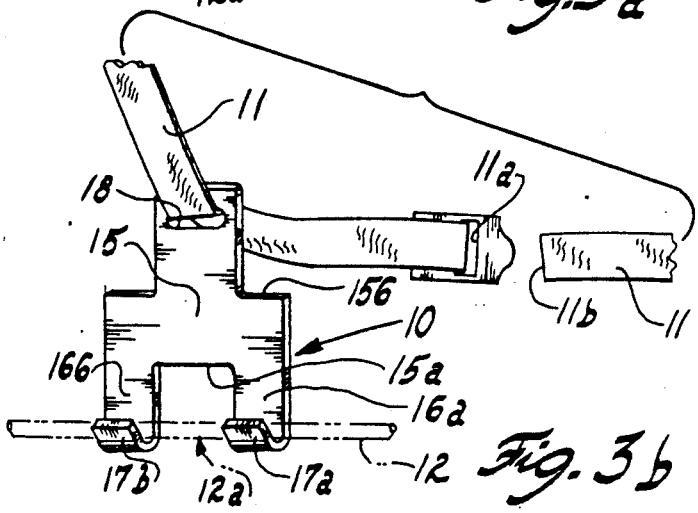
Figure 4C:
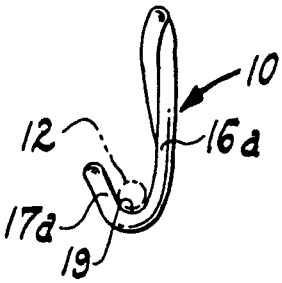
Figure 3C:
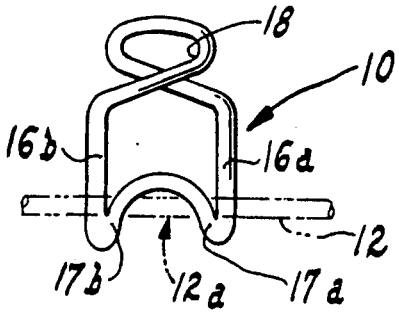

The holder 10 shown in FIGS. 3C and 4C is similar except that the hook body 16*a*, 16*b* and hook lip 17*a*, 17*b* are joined together and formed in a single continuous length.

The holder at its rear margin 15*b* (FIGS. 3A, 4A, 3B and 4B) includes a sling attachment body portion with an open slot 18. The holder of FIG. 3C has a similar sling attachment loop portion 18 forming an opening at its inner surfaces.

As shown in FIGS. 3A and 4A, the holder is provided with a sling closed loop 11*c* with upper and lower loop ends. The lower end is attached to the holder body by forming the lower loop through the body opening 18. The upper loop is used for attaching a sling 11 of suitable length having a buckle 11*a* at one end and an open end 11*b* for threading through the upper loop. The combination of the holder 10, the loop 11*c* and the sling 11 is especially useful for applications where twisting of the sling and holder is to be avoided.

A similar arrangement is shown in FIGS. 3B and 4B where the sling 11 is directly attached to the holder 10 through the attachment opening 18. Similarly, the holder 10 of FIGS. 3C and 4C can be attached through its opening 18 by means of the sling 11 and closed loop 11*c* (FIGS. 3A and 4A) or by means of the sling 11 alone (FIGS. 3B and 4B).

The materials used for the holder, the strapping, slings, buckles and the like can be conventional materials such as rigid plastic, e.g. formed by molding or stamping from sheet material, or formed metal wire or metal sheet, e.g. aluminum sheet, preferably coated with a non-reflective flat black surface, or in the case of strapping, a uniformly dark colored, durable strapping. The holder dimensions can be varied according to individual requirements. For example, suitable specification for the holder shown in FIG. 3A is about $\frac{1}{2} \times 1\frac{1}{2}$ inches for the holder body 15, about $\frac{3}{4}$ inch spacing between the hook bodies 16*a*, 16*b*, and about $\frac{1}{4}$ inch maximum between the hook body 16*a* and hook lip 17*a*. The lip angle is ca. 45° and slant height, $\frac{1}{4}$ inch.

The embodiments of the invention in which an exclusive property or privilege is claimed are defined as follows:

1. A bow-string holder in combination with a shoulder sling and a planar closed loop sling strap contoured to lie flat, for use by an archer and while sling-held for carrying a bow or standing with an armed or unarmed bow, the sling comprising means for adjusting its effective length size from the shoulder such that the bow-string of the bow is carried by said holder at a distance substantially above the waist of the archer, said bow-string holder having a planar body that is dimensioned and contoured to lie flat at a stand-by position and a shooting position above the waist and under the bow arm against the archer's body in close proximity to but with spacing from the archer's relaxed bow arm in the stand-by position and is further dimensioned to provide spacing from the intended bow string path when drawn back by the drawing arm for shooting in the shooting position, the planar body of the holder further having front and rear margins and including at the front margin cooperating spaced apart hooks all portions of which are located forwardly of the plane of the planar body and are sufficiently compact at said stand-by and shooting positions to space the hooks from respectively the relaxed arm and the intended string path, the hooks being configured for engagement in hooking and upwardly supporting relation substantially above the waist of the archer with the horizontally held bow-string of a bow, said hooks while so engaged being positioned axially for balance at or closely adjacent to a balance point of the box with the bow below the bow-string thereby allowing a nocked arrow of a holder-supported armed bow to lie flat against the archer's body in the stand-by position, the rear margin of the holder having means for slinged support from the shoulder for hands-free carrying and standing with the bow-string under the bow arm substantially above the waist balancing the bow, the sling strap having a flat profile and comprising an upper loop end with said sling threaded therethrough and a lower loop end attached to said rear margin in a position such that when sling-held substantially above the waist and under the arm the planar body of the holder and its thus attached sling strap are held in coplanar relation flat against the archer's body whereby twisting of the sling and holder is avoided.

2. A bow-string holder according to claim 1, where the hooks are J-shaped.

3. A bow-string holder according to claim 1, where the axial spacing between the hooks is such that when an arrow is placed on the bow-string the hooks lie closely adjacent to the arrow end.

4. A bow-string holder according to claim 1, wherein the lower loop end is attached to the rear margin by means of a slot in the holder for receiving the lower loop end therethrough.

5. A bow-string holder according to claim 1, where the sling is slidable through the upper loop end of the sling strap to facilitate size-adjustment of the sling.

* * * * *

UNITED STATES PATENT AND TRADEMARK OFFICE

CERTIFICATE OF CORRECTION

PATENT NO. : 5,038,987

DATED : August 13, 1991

INVENTOR(S) : Jerry Huddleston

It is certified that error appears in the above-identified patent and that said Letters Patent is hereby corrected as shown below:

In the Abstract, line 10, "low-string" should be --bow-string--.

Signed and Sealed this

Thirteenth Day of October, 1992

*Attest:*

DOUGLAS B. COMER

*Attesting Officer*

*Acting Commissioner of Patents and Trademarks*